US009011795B2

(12) United States Patent
Lee et al.

(10) Patent No.: US 9,011,795 B2
(45) Date of Patent: Apr. 21, 2015

(54) VALVE UNIT, MICROFLUIDIC DEVICE WITH THE VALVE UNIT, AND MICROFLUIDIC SUBSTRATE

(75) Inventors: Beom-seok Lee, Yongin-si (KR); Yoon-kyoung Cho, Suwon-si (KR); Jeong-gun Lee, Seoul (KR); Jong-myeon Park, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1075 days.

(21) Appl. No.: 11/937,135

(22) Filed: Nov. 8, 2007

(65) Prior Publication Data

US 2008/0112855 A1 May 15, 2008

(30) Foreign Application Priority Data

Nov. 9, 2006 (KR) ..... 10-2006-0110543

(51) Int. Cl.
*B01L 3/00* (2006.01)

(52) U.S. Cl.
CPC ... *B01L 3/502738* (2013.01); *B01L 2300/0806* (2013.01); *B01L 2300/1861* (2013.01); *B01L 2400/0409* (2013.01); *B01L 2400/0677* (2013.01)

(58) Field of Classification Search
CPC ..... B01L 2400/0677; B01L 2400/0409; B01L 3/502738; B01L 2300/0806; B01L 2300/0867; B01L 2200/16; B01L 2300/0803; B01L 3/502753; B01L 2300/087; B01L 3/502761; B01L 2200/0684; B01L 2300/0864; B01L 2200/0621; B01L 2200/0647; B01L 2300/04; B01L 9/527; B01L 2200/0642; B01L 2200/10; B01L 2300/0861; B01L 2400/06; B01L 2400/0622; B01L 2400/0633; B01L 2400/0683; B01L 2400/0688; F16K 99/0001; F16K 99/0032; F16K 99/004; F16K 2099/0084; F16K 99/0019; F16K 2099/008; F16K 99/0034; F16K 99/0021; F16K 99/003; G01N 35/00069; G01N 33/54313; G01N 33/54326; G01N 33/54366; B01F 13/0059; B01F 15/0201; B01F 15/0233
USPC ..... 422/99–103; 436/180
See application file for complete search history.

(56) References Cited

U.S. PATENT DOCUMENTS

2003/0044322 A1* 3/2003 Andersson et al. ..... 422/100
2004/0007275 A1* 1/2004 Hui Liu et al. ..... 137/828

(Continued)

FOREIGN PATENT DOCUMENTS

JP 2003-503716 A 1/2003
JP 2004-502164 A 1/2004

(Continued)

OTHER PUBLICATIONS

Robin Hui Liu, et al., "Self-Contained, Fully Integrated Biochip for Sample Preparation, Polymerase Chain Reaction Amplification, and DNA Microarray Detection", Analytical Chemistry, vol. 76, No. 7, Apr. 1, 2004, pp. 1824-1831.

(Continued)

*Primary Examiner* — Dean Kwak
(74) *Attorney, Agent, or Firm* — Sughrue Mion, PLLC

(57) ABSTRACT

Provided are a valve unit and a microfluidic device including the valve unit. The valve unit includes: a valve substance container containing a valve substance, the valve substance including a phase change material that is solid at ambient temperature and melts by absorbing energy; a valve connection path connecting the valve substance container to a channel forming a fluid passage; and a pair of drain chambers formed along the channel at both sides of the valve connection path.

26 Claims, 15 Drawing Sheets

(56) References Cited

U.S. PATENT DOCUMENTS

| | | | | |
|---|---|---|---|---|
| 2004/0018611 | A1* | 1/2004 | Ward et al. | 435/287.2 |
| 2004/0053290 | A1* | 3/2004 | Terbrueggen et al. | 435/6 |
| 2004/0219732 | A1 | 11/2004 | Burns et al. | |
| 2005/0247356 | A1 | 11/2005 | Welle | |
| 2006/0093528 | A1* | 5/2006 | Banerjee et al. | 422/103 |
| 2007/0184547 | A1* | 8/2007 | Handique et al. | 435/288.5 |

FOREIGN PATENT DOCUMENTS

| | | | |
|---|---|---|---|
| JP | 2004-537695 | A | 12/2004 |
| JP | 2006-508790 | A | 3/2006 |
| JP | 2006-133683 | A | 5/2006 |
| JP | 2006-300145 | A | 11/2006 |
| WO | 2005036182 | A1 | 4/2005 |
| WO | 2005/107947 | A1 | 11/2005 |
| WO | 2006/104467 | A1 | 10/2006 |

OTHER PUBLICATIONS

Japanese Patent Office, Communication dated Jul. 24, 2012, issued in counterpart Japanese Application No. 2007-284068.

Japanese Patent Office, Communication dated Jan. 22, 2013 issued in counterpart Japanese Application No. 2007-284068.

* cited by examiner

VALVE UNIT, MICROFLUIDIC DEVICE WITH THE VALVE UNIT, AND MICROFLUIDIC SUBSTRATE

CROSS-REFERENCE TO RELATED PATENT APPLICATION

This application claims the benefit of Korean Patent Application No. 10-2006-0110543, filed on Nov. 9, 2006, in the Korean Intellectual Property Office, the disclosure of which is incorporated herein in its entirety by reference.

BACKGROUND OF THE INVENTION

1. Field of the Invention

The present invention relates to a valve unit for timely closing and opening a microfluidic channel, a microfluidic device including the valve unit, and a microfluidic substrate.

2. Description of the Related Art

Microfluidic channels are generally formed in a substrate (e.g., a lab-on-a-chip) used for performing, for example, biochemical reactions such as a lysis reaction and a polymerase chain reaction (PCR). A valve unit may be used to timely close and open such a microfluidic channel to regulate a fluid flow.

FIG. 1 is a plan view illustrating a conventional valve unit 10 disclosed in Robin Hui Liu et al., Anal. Chem. Vol. 76, pp. 1824-1831, 2004.

Referring to FIG. 1, the valve unit 10 includes a micro channel 12 forming a fluid passage, paraffin wax 20 preventing a flow of fluid (F) by closing the micro channel 12, and a wax chamber 15 adjacent to the paraffin wax 20. When it is necessary to move the fluid (F), heat (H) is applied to the paraffin wax 20 to melt the paraffin wax 20. As a result, the micro channel 12 is opened, and the fluid (F) can flow downward in the direction of the phantom arrow. Since the melted paraffin wax 20 is collected in the wax chamber 15, which is a widened area of the micro channel 12, the flow of the fluid (F) is not obstructed by the paraffin wax 20.

The valve unit 10 is called an open valve unit. That is, the valve unit 10 opens the initially-closed micro channel 12. In contrast, a close valve unit blocks an initially-opened micro channel. These known open valve unit and the close valve unit can either open or close microchannels, but are not be able to function to open and close a micro channel. In addition, a valve unit that can repeatedly open and close a micro channel has not been proposed yet. However, a substrate suitable for complex fluid reactions becomes quite bulky since several microfluidic chambers, channels, and open valve units and close valve units should be included in the substrate. Furthermore, the process of manufacturing the substrate is expensive and time-consuming.

SUMMARY OF THE INVENTION

The present invention provides a valve unit that can both close and open a channel, a microfluidic device including the valve unit, and a microfluidic substrate.

The present invention also provides a valve unit that can repeatedly close and open a channel, a microfluidic device including the valve unit, and a microfluidic substrate.

According to an aspect of the present invention, there is provided a valve unit and a microfluidic device including the valve unit. The valve unit includes: a first and a second drain chambers formed along the channel, the drain chambers are spaced from each other; a valve substance including a phase change material that is non-fluidic at ambient temperature and fluidic when energy is applied thereto; a valve substance container which contains the valve substance; and a valve connection path which connects the valve substance container to the channel, in which a connection point of the channel where the valve connection path meets the channel is located between the first drain chamber and the second drain chamber, wherein when energy is applied to the valve substance contained in the valve substance container, the valve substance becomes fluidic and at least portion of the valve substance flows to the channel through the valve connection path, and the portion of the valve substance flowed in the channel becomes non-fluidic and blocks the channel; and when energy is applied to the portion of the valve substance blocking the channel, the portion of the valve substance becomes fluidic and discharged to the drain chambers to open the channel.

According to another aspect of the present invention, there is provided a microfluidic substrate including: a channel which forms a fluid passage; a first and a second drain chambers formed along the channel, the drain chambers are spaced from each other; a valve substance including a phase change material that is non-fluidic at ambient temperature and fluidic when energy is applied thereto; a valve substance container which contains the valve substance; and a valve connection path which connects the valve substance container to the channel, in which a connection point of the channel where the valve connection path meets the channel is located between the first drain chamber and the second drain chamber, wherein when energy is applied to the valve substance contained in the valve substance container, the valve substance becomes fluidic and at least portion of the valve substance flows to the channel through the valve connection path, and the portion of the valve substance flowed in the channel becomes non-fluidic and blocks the channel; and when energy is applied to the portion of the valve substance blocking the channel, the portion of the valve substance becomes fluidic and discharged to the drain chambers to open the channel.

According to another aspect of the present invention, there is provided a valve unit which includes: a channel which forms a fluid flow path; a valve substance including a phase change material that is non-fluidic at ambient temperature and fluidic when energy is applied thereto; a valve substance container which contains the valve substance; a first area of a first dimension ("D1"), which is formed in the channel; a pair of second areas of a second dimension ("D2"), which are formed in the channel and spaced from each other with a gap ("G"); and a valve connection path which fluid connects the valve substance container to the first area, wherein the gap between the pair of the second areas corresponds to the first area, wherein D1>D2; wherein D2 is smaller than the dimension of the channel; wherein when energy is applied to the valve substance contained in the valve substance container, the valve substance becomes fluidic and at least portion of the valve substance flows to the channel through the valve connection path, and the portion of the valve substance flowed into the channel becomes non-fluidic and blocks the channel at the second areas; and when energy is applied to the portion of the valve substance blocking the channel, the portion of the valve substance becomes fluidic, resulting in opening the channel.

According to still another aspect of the present invention, there is provided a microfluidic device including a substrate composed of a first plate and a second plate, which are coupled to each other to provide a channel which forms a fluid flow path; a chamber to receive a fluid from the channel; and a valve unit to control the flow of the fluid in the channel, wherein the valve unit includes a valve substance including a phase change material that is non-fluidic at ambient temperature and fluidic when energy is applied thereto; a valve substance container which contains the valve substance; a first area of a first dimension ("D1"), which is formed in the channel; a pair of second areas of a second dimension ("D2"), which are formed in the channel and spaced from each other with a gap ("G"); and a valve connection path which fluid connects the valve substance container to the first area, wherein the gap between the pair of the second areas corresponds to the first area, wherein D1 >D2; wherein D2 is smaller than the dimension of the channel; wherein when energy is applied to the valve substance contained in the valve substance container, the valve substance becomes fluidic and at least portion of the valve substance flows to the channel through the valve connection path, and the portion of the valve substance flowed into the channel becomes non-fluidic and blocks the channel at the second areas; and when energy is applied to the portion of the valve substance blocking the channel, the portion of the valve substance becomes fluidic, resulting in opening the channel.

There may be provided an external energy source which radiates electromagnetic waves to the valve substance.

The energy source may include a laser light source emitting laser light.

The laser light source may include a laser diode.

The laser light emitted from the laser light source may be pulsed electromagnetic waves having an energy rate of at least 1 mJ/pulse.

The laser light emitted from the laser light source may be continuous electromagnetic waves having a power of at least 10 mW.

The laser light emitted from the laser light source may have a wavelength in a range of 750 nm to 1300 nm.

The energy source may emit infrared light or inject a high-temperature gas. The gas may have a temperature at which the phase change material can be melted to fluidic state, for example about 65-80° C.

The valve substance may further include a number of fine thermal particles dispersed into the phase change material and capable of emitting heat by absorbing energy.

The fine thermal particles may have a diameter in a range of 1 nm to 100 μm.

The fine thermal particles may be dispersed into hydrophobic carrier oil.

The fine thermal particles may include a ferromagnetic material or a metal oxide.

The metal oxide may include at least one selected from the group consisting of $Al_2O_3$, $TiO_2$, $Ta_2O_3$, $Fe_2O_3$, $Fe_3O_4$ and $HfO_2$.

The fine thermal particles may be polymer particles, quantum dots, or magnetic beads.

The magnetic beads may include at least one component selected from the group consisting of Fe, Ni, Cr, and an oxide thereof The phase change material may be at least one material selected from the group consisting of wax, a gel, and a thermoplastic resin.

The wax may be at least one selected from the group consisting of paraffin wax, microcrystalline wax, synthetic wax, and natural wax.

The gel material may be at least one material selected from the group consisting of polyacrylamide, polyacrylate, polymethacrylate, and polyvinylamide.

The thermoplastic resin may be at least one resin selected from the group consisting of cyclic olefin copolymer (COC), polymethylmethacrylate (acrylic) (PMMA), polycarbonate (PC), polystyrene (PS), polyacetal engineering polymers (POM), perfluoroalkoxy (PFA), polyvinyl chloride (PVC), polypropylene (PP), polyethylene terephthalate (PET), polyetheretherketone (PEEK), polyamide (PA), polysulfone (PSU), polyvinylidene difluoride (PVDF), or the like may be employed as the thermoplastic resin.

In one exemplary embodiment, the valve substance container may be connected to a plurality of separate channels each through a valve connection path, each of the channels forming the fluid passage and provided with the first drain chamber and the second drain chamber.

The valve unit may further include: a fluid chamber which contains a fluid; and a fluid connection path which connects the fluid chamber to the valve substance container at the connection point of the channel, wherein when energy is applied to the valve substance contained in the valve substance container, the valve substance becomes fluidic and at least portion of the valve substance flows to the channel and to the fluid connection path through the valve connection path, and the portion of the valve substance flowed in the channel and the fluid connection path becomes non-fluidic and blocks the channel and the fluid connection path; and when energy is applied to the portion of the valve substance blocking the channel and the fluid connection path, the portion of the valve substance becomes fluidic and discharged to the drain chambers to open the channel and the fluid connection path.

In the microfluidic device, the valve substance container, the valve connection path, and the drain chambers may be formed in a substrate together with the channel, and the energy source may be disposed outside the substrate.

At least a portion of the substrate may be transparent so as to allow the electromagnetic waves to propagate through the substrate.

The microfluidic device may further include an actuating unit which rotates the substrate, wherein the fluid is pumped by a centrifugal force generated when the actuator rotates the substrate.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

A valve unit and a microfluidic device including the valve unit will now be described more fully with reference to the accompanying drawings, in which exemplary embodiments of the invention are shown.

Figure 1:
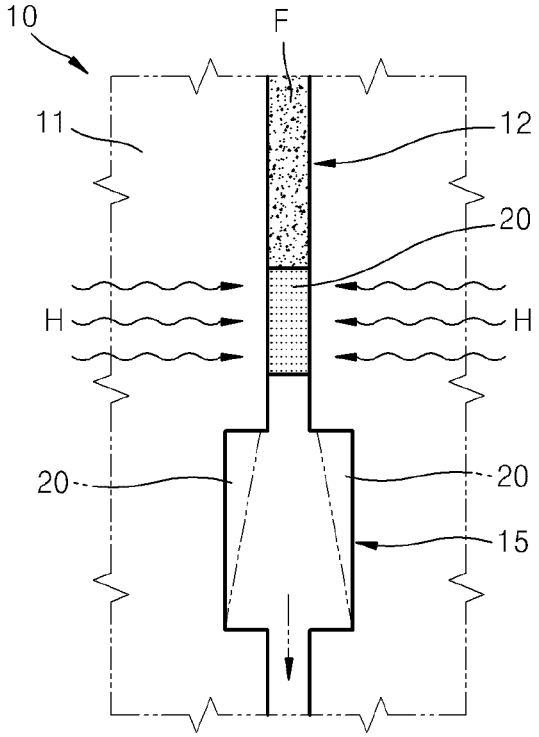
FIG. 1 (RELATED ART)
FIG. 1 is a plan view illustrating a conventional valve unit.
Figure 2A:
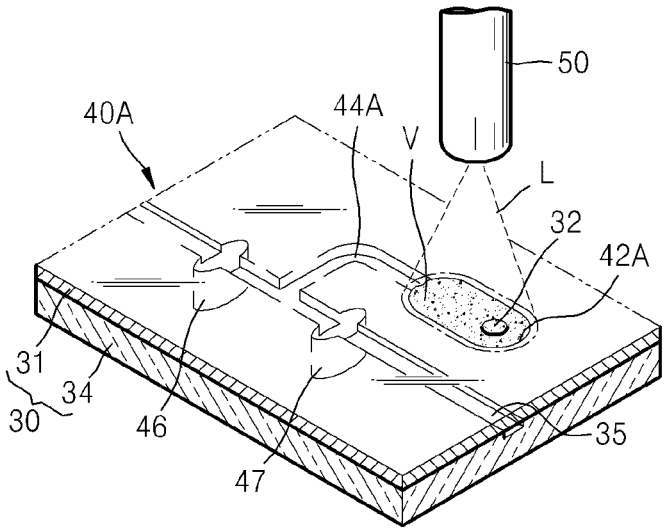
FIGS. 2A through 2F are perspective views for explaining an operation of a valve unit according to an embodiment of the present invention.
Figure 2B:
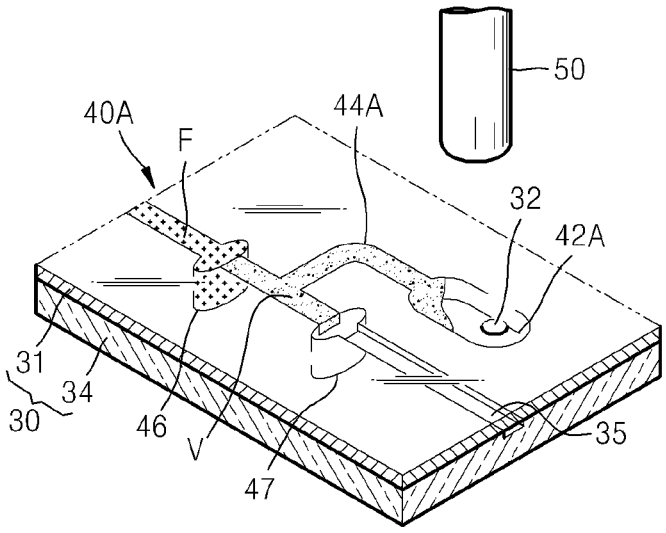
Figure 2C:
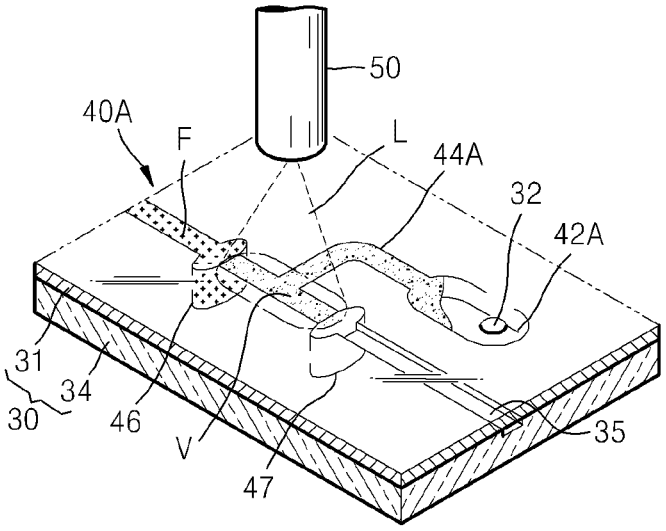
Figure 2D:
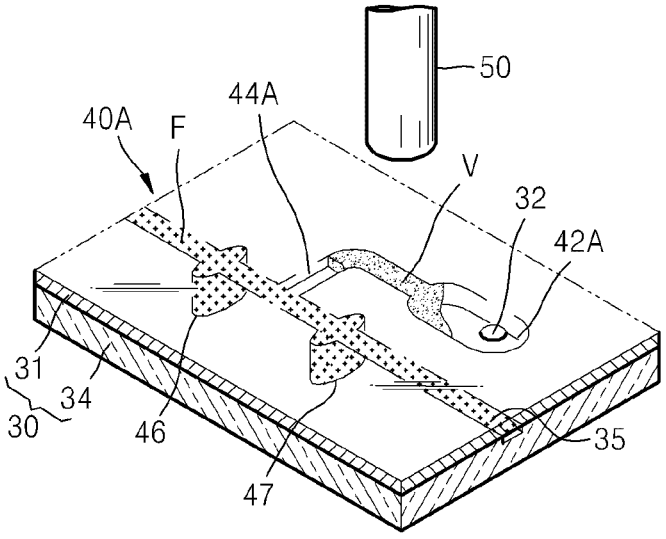
Figure 2E:
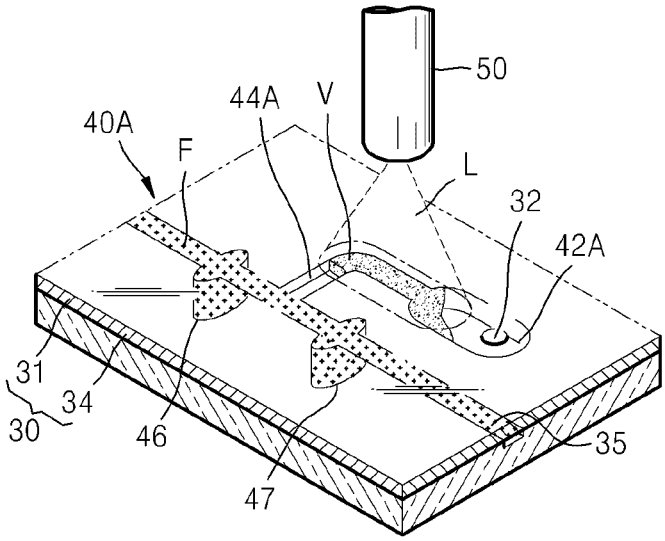
Figure 2F:
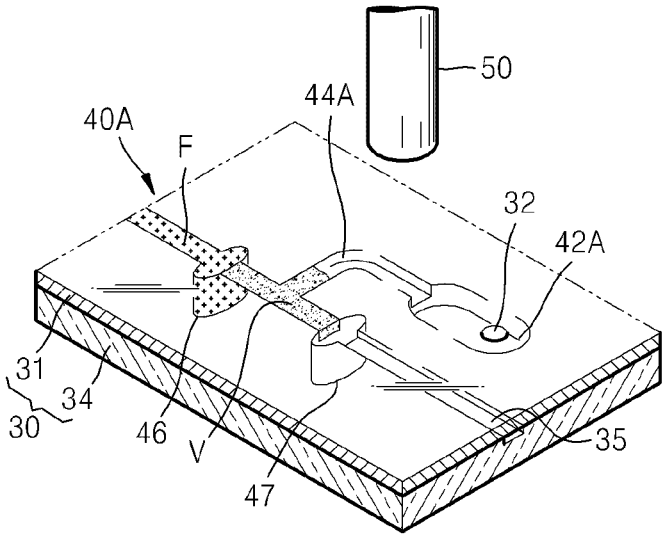
Figure 3:
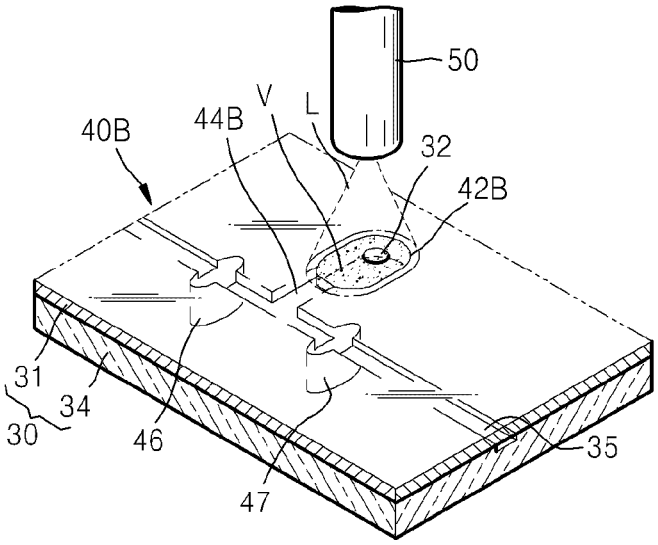
FIG. 3 is a perspective view illustrating a valve unit according to another embodiment of the present invention.

FIGS. 2A through 2F are perspective views for explaining an operation of a valve unit 40A according to an embodiment of the present invention, and FIG. 3 is a perspective view illustrating a valve unit according to another embodiment of the present invention.

Referring to FIGS. 2A through 2F, the valve unit 40A according to an embodiment of the present invention includes a valve substance container 42A, a valve substance (V) contained in the valve substance container 42A, a valve connection path 44A connecting the valve substance container 42A to a channel 35, which forms a passage for fluid (F), and a pair of drain chambers 46 and 47 formed along the channel 35 at both sides of the valve connection path 44A. It should be understood that the chambers and containers are fluid connected to the channel and have a greater depth than the channels. The valve unit 40A further includes an energy source such as a laser light source 50 to supply energy to the valve substance V. The laser light source 50 emits a laser light (L) (electromagnetic waves). However, the energy source of the present invention is not limited to the laser light source 50. That is, other devices such as an infrared source or a high-temperature gas injector can be used as the energy source.

The valve substance container 42A, the channel 35, the valve connection path 44A, and the drain chambers 46 and 47 can be formed in a substrate 30 formed of a upper and a lower plates 31 and 34, which are bonded together. For example, the first and second plates 31 and 34 can be bonded by a known method, such as using an adhesive agent, a double-sided tape, or ultrasonic welding.

Figure 5:
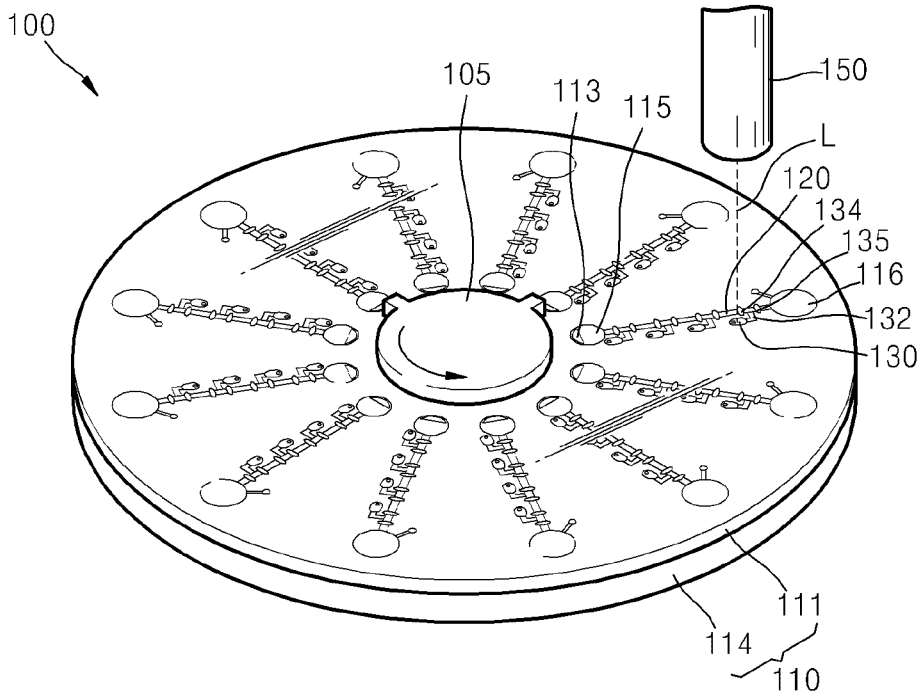
FIG. 5 is a perspective view illustrating a fluid treating apparatus including the valve unit depicted in FIGS. 2A through 2F, according to an embodiment of the present invention.

One exemplary embodiment of the substrate 30 is shown in FIG. 5. For example, the valve substance container 42A, the channel 35, the valve connection path 44A, and the drain chambers 46 and 47 may be formed in the lower plate 34, and a valve substance injection hole 32 is formed through the upper plate 31 to fill the valve substance container 42A with the valve substance V. The channel 35 and the valve connection path 44A have micro dimensions (about 1 mm wide and about 0.1 mm deep). In one embodiment, the drain chambers 46 and 47 are about 3 mm deep, and the valve substance container 42A is not deeper than the drain chambers 46 and 47. For example, the valve substance container 42A is about 1 mm deep.

At least a portion or all portion of the upper plate 31 of the substrate 30 is transparent, such that laser light (L) emitted from the laser light source 50 located above the substrate 30 can be irradiated to the valve substance (V) through the upper plate 31. The laser light source 50 is provided in a way to allow its free movement in a precisely controlled manner above the substrate so that it can irradiate laser light to an exact target point of the substrate. The upper plate 31 may be formed of glass or a transparent plastic. The lower plate 34 can be formed of the same material as the upper plate 31. Alternatively, the lower plate 34 can be formed of a silicon material having a high thermal conductivity. In this case, reactions requiring thermal cycles such as a polymerase chain reaction (PCR) can be performed rapidly and reliably using the valve unit 40A.

The valve substance (V) includes a phase change material that is non-fluidic (e.g., solid) at ambient temperature, and a number of fine thermal particles uniformly dispersed throughout the phase change material. The thermal particles generate heat when energy is applied to them. It should be understood that the term "fluidic" as employed herein refers to the condition that the valve substance (V) or the phase change material can move or flow along the channels or from the chamber /container to the channel, and vice versa. The flow may be caused by centrifugal force generated by rotations of the microfluidic substrate. The term "non-fluidic" as employed herein refers to the condition that the valve substance (V) or the phase change material does not move or flow due to its lowered viscosity and hardens enough to effectively block a flow of fluid in the channel even when the microfluidic substrate rotates.

The phase change material can be wax. The wax melts into a fluid and increase in volume, when heat is applied to the wax. For example, the wax can be paraffin wax, microcrystalline wax, synthetic was, or natural wax.

Alternatively, the phase change material can be a gel or a thermoplastic resin. For example, the gel may be polyacrylamide, polyacrylate, polymethacrylate, or polyvinylamide. The thermoplastic resin may be cyclic olefin copolymer (COC), polymethylmethacrylate(PMMA), polycarbonate (PC), polystyrene(PS), polyoxymethylene(POM), perfluoralkoxy(PFA), polyvinylchloride(PVC), polypropylene(PP), polyethylene terephthalate(PET), polyetheretherketone (PEEK), polyamide(PA), polysulfone(PSU), or polyvinylidene fluoride(PVDF).

The fine thermal particles have a diameter in the range of 1 nm to 100 μm, such that the fine thermal particles can freely pass through the channel 35 and the valve connection path 44A. The fine thermal particles rapidly increase in temperature and emit heat when energy is supplied to them. The energy sources may be, for example, laser light irradiation. Further, the fine thermal particles can be uniformly dispersed throughout the wax. The fine thermal particles may have a structure that has a metallic core and a hydrophobic surface covered on the core. For example, the thermal particles can have a molecular structure including a Fe core and a layer of surfactants coupled to the Fe core and surrounding the Fe core.

Usually, the fine thermal particles are available and employed as a dispersion in a carrier oil. The carrier oil may be hydrophobic so as to allow the hydrophobic fine thermal particles to be dispersed uniformly therein. The valve substance (V) can be manufactured by mixing wax with a carrier oil dispersion of the fine thermal particles. In the above description, the fine thermal particles have a polymer type particle structure. However, the fine thermal particles may have other particle structures such as a quantum dot structure or a magnetic bead structure.

Figure 4:
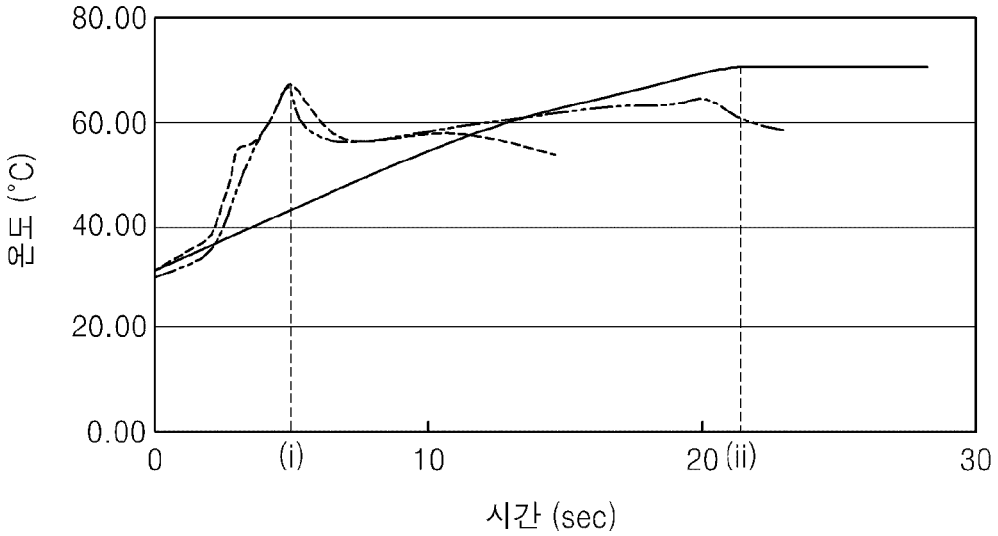
FIG. 4 is a temperature-time graph for the case when a laser light is projected onto pure paraffin wax and paraffin wax containing fine thermal particles that emit heat so as to compare melting point versus time properties of the pure paraffin wax and the paraffin wax containing the fine thermal particles according to an embodiment of the present invention.
Figure 4:
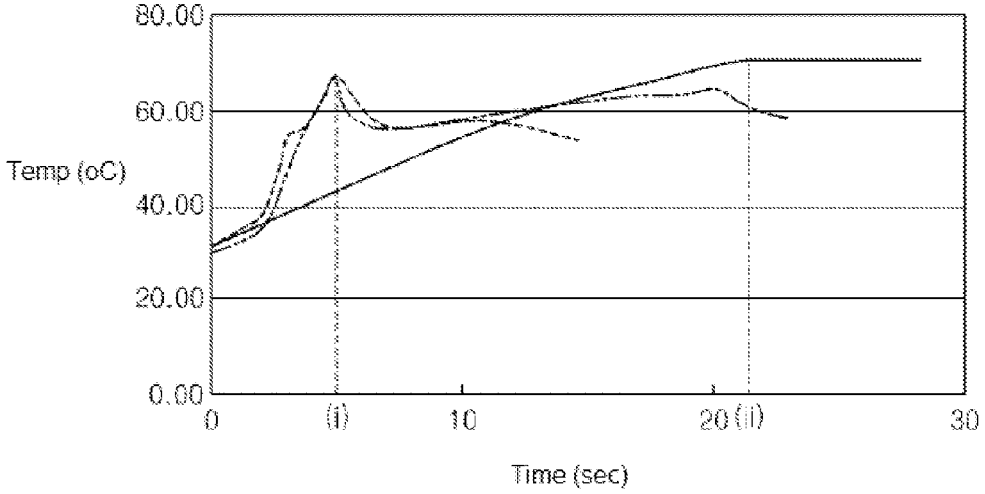

FIG. 4 is a temperature-time graph for the case when a laser light is projected onto pure paraffin wax and paraffin wax containing fine thermal particles that emit heat. FIG. 4 shows the melting point with respect to the lapse of the time, measured for the pure paraffin wax and the paraffin wax containing the fine thermal particles according to an embodiment of the present invention.

Referring to FIG. 4, a solid line denotes a temperature curve of 100% pure paraffin wax. A dashed line denotes a temperature curve of 50% (v/v) paraffin wax-50%(v/v) fine thermal particles. The 50% (v/v) paraffin wax-50%(v/v) fine thermal particles is also known as 50% impurity paraffin wax, and is a 1:1 mixture of pure paraffin wax and a carrier oil dispersion of 10-nm fine thermal particles. A phantom line (long dashed double-short-dashed line) denotes a temperature curve of 20% impurity paraffin wax. The 20% impurity paraffin wax is a 4:1 mixture of pure paraffin wax and a carrier oil dispersion of 10-nm fine thermal particles. An 808-nm wavelength laser is used for the experiment of FIG. 4. Pure paraffin wax melts at about 68° C. to 74° C. Referring to FIG. 4, when laser light is irradiated to the pure paraffin wax, the pure paraffin wax reaches its melting point after 20 sec or more (refer to (ii) in FIG. 4). On the other hand, the 50% impurity paraffin wax and the 20% impurity paraffin wax are rapidly heated by laser light irradiation and reach their melting points within about 5 sec after the laser light irradiation (refer to (i) in FIG. 4).

The fine thermal particles can include a ferromagnetic material such as Fe, Ni, Co, or an oxide thereof Further, the fine thermal particles can include a metal oxide such as $Al_2O_3$, $TiO_2$, $Ta_2O_3$, $Fe_2O_3$, $Fe_3O_4$, or $HfO_2$.

Referring again to FIGS. 2A through 2F, the laser light source 50 can include a laser diode. A laser light source capable of emitting pulsed laser light at an energy rate of 1 mJ/pulse or higher, or a laser light source capable of emitting continuous wave laser light at a power of 10 mW or greater can be used as the laser source 50 in the current embodiment of the present invention. The laser light source 50 is provided in a way to allow its free movement in a precisely controlled manner above the substrate so that it can irradiate laser light to an exact target point of the substrate. For example, although not shown in FIGS. 2A through 2F, the valve unit 40A can further include a collimating unit for adjusting the irradiation direction and area irradiated by laser light (L). Further, the valve unit 40A may include additional external laser light source (not shown). The collimating unit can include at least one lens and at least one mirror.

Referring to FIG. 2A, when the laser light (L) is irradiated for a short time to the valve substance (V), which is in non-fluidic phase (i.e., hardened) inside the valve substance container 42A using the laser light source 50, the valve substance (V) rapidly expands while changing into a fluidic phase (i.e., melted phase). Thus, the fluidic (i.e., melted) valve substance (V) flows into the channel 35 through the valve connection path 44A. The fluidity of the fluidic valve substance (V) increases as it flows into the channel. Referring to FIG. 2B, in the channel 35, the valve substance (V) stays between the drain chambers 46 and 47 due to its reduced fluidity and surface tension, and thus the channel 35 is closed. As a result, fluid (F) cannot flow along the channel 35. Some of the valve substance (V) may be introduced in the drain chambers 46 and 47.

Referring to FIG. 2C, when the laser light (L) is irradiated to the valve substance (V), which now is filled in the channel 35 between the drain chambers 46 and 47 and thus blocks the channel 35, for a short time using the laser light source 50, the valve substance (V) rapidly expands while melting and is removed from the channel 35. As the amount of the valve substance (V), which blocks the channel 35 in its non-fluidic phase, is small and the melted valve substance (V) may be introduced into the fluid F. Thus, as shown in FIG. 2D, the channel 35 is opened again to allow the fluid (F) to flow along the channel 35.

Referring to FIG. 2E, when the laser light (L) is irradiated to the hardened valve substance (V) remaining in the valve substance container 42A and the valve connection path 44A for a short time using the laser light source 50, the valve substance (V) explosively expands while melting, flows into the channel 35, and hardens in the channel 35. Thus, as shown in FIG. 2F, the channel is closed again. In this way, the channel 35 can be iteratively closed and opened by repeatedly irradiating the laser light (L). Thus, according to the present invention, it is possible to close and open a channel using a valve substance, by adjusting the initial amount of the valve substance contained in the container 42A and the amount of the valve substance which is melted and used to block the channel, which can be done by adjusting the condition of the laser light irradiation and the temperature-melting point properties of the valve substance and the distance of the valve connection path 44A.

Figure 10:
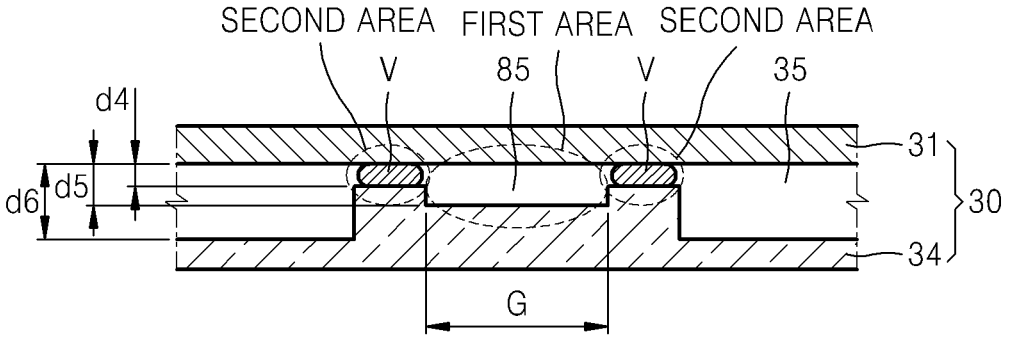
FIG. 10 is a sectional view of a valve unit according to another embodiment of the present invention.

Even though embodiments of valve units having drain chambers have been explained and illustrated, the present invention encompasses valve units without drain chambers. For example, a valve unit may include a fluid channel which has a greater dimension than the valve area (i.e., the location of the fluid channel where non-fluidic valve material blocks the flow of a fluid). An cross sectional view of an exemplary valve unit without drain chambers is shown in FIG. 10. As shown in FIG. 10, the intersection area 85 has a dimension "d5," and the valve area where valve material V is solidified and blocks the channel has a dimension "d4," and the channel 35 has a dimension "d6." The microfluidic device 30 also has a upper plate 31 and a lower plate 34. The connection path (not shown) is fluid connected to the intersection area 85 so that the valve substance in the valve substance container (not shown) can flow from the container (not shown) to the intersection area 85 ("first area" in FIG. 10) through the connection path (not shown), and to the channel 35. The first area (or intersection area) 85 is formed in the channel and has a dimension "d5". The valve unit also has a pair of second areas of a dimension ("d4"), which are formed in the channel and spaced from each other with a gap ("G"). The dimension d5 of the first area (or intersection area) 85 is larger than the dimension d4 of the second areas, and the dimension of the channel 35 is greater than the dimension d4 of the second areas. When energy is applied to the valve substance contained in the valve substance container (not shown), the valve substance becomes fluidic and at least portion of the valve substance flows to the channel 35 through the valve connection path (not shown), and the portion of the valve substance flowed into the channel becomes non-fluidic and blocks the channel at the second areas; and when energy is applied to the portion of the valve substance blocking the channel, the portion of the valve substance becomes fluidic, resulting in opening the channel.

A valve unit of such a structure is explained in more detail in a commonly assigned co-pending application Ser. No. 11/770,762, content of which is incorporated herein in its entirety. The valve unit described in application Ser. No. 11/770,762 may be modified to have a valve substance container and a valve connection path.

Referring to FIG. 3, a valve unit 40B is illustrated according to another embodiment of the present invention. In the valve unit 40B, a valve connection path 44B connecting a valve substance container 42B and a channel 35 is straight unlike the curved valve connection path 44A of the embodiment illustrated in FIGS. 2A through 2F. That is, the valve connection path 44B of the current embodiment is relatively short. Thus, the valve unit 40B can be reduced in size and integrated more highly. However, in the current embodiment, the irradiation direction and area irradiated by the laser light (L) need to be controlled more precisely than in the valve unit 40A of the embodiment illustrated in FIGS. 2A through 2F.

Figure 6A:
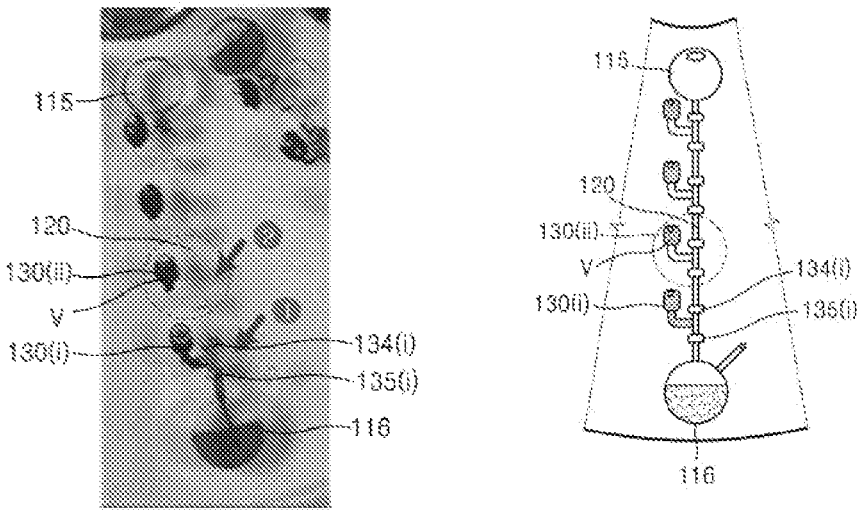
FIGS. 6A through 6C are photographic images illustrating operation test results of the fluid treating apparatus depicted in FIG. 5, according to an embodiment of the present invention, each accompany with respective illustrative drawings.
Figure 6B:
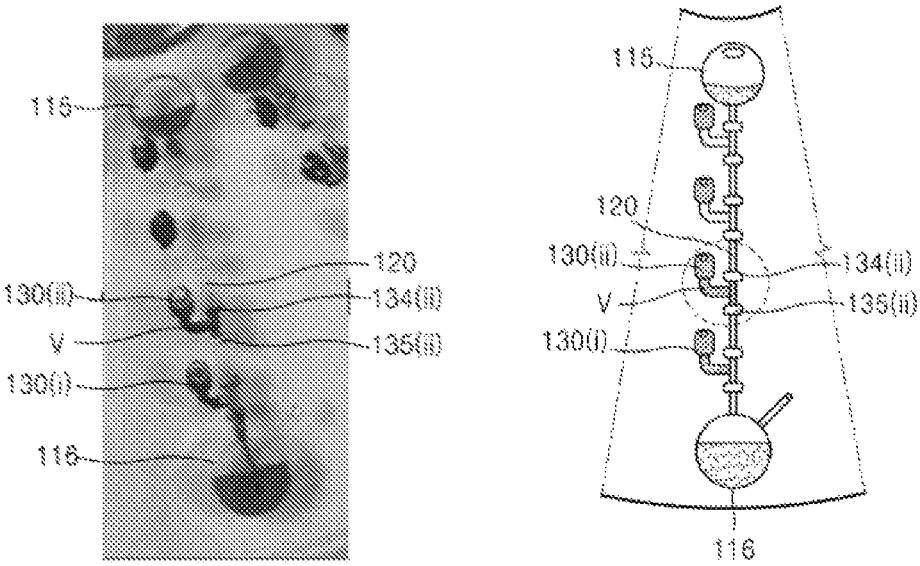
Figure 6C:
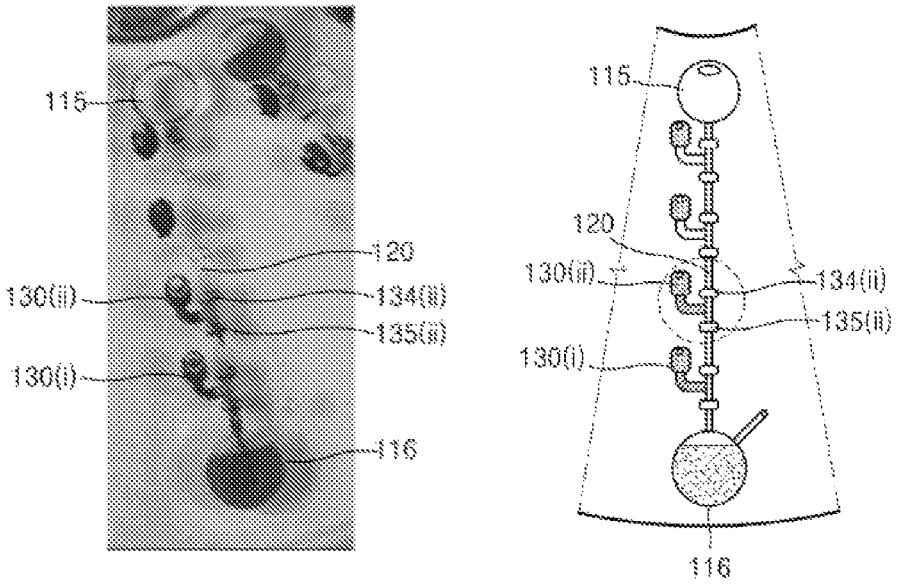

FIG. 5 is a perspective view illustrating a microfluidic device 100 including the valve unit 40A depicted in FIGS. 2A through 2F, according to an embodiment of the present invention, and FIGS. 6A through 6C are photographic images illustrating operation test results of the microfluidic device 100 depicted in FIG. 5, according to an embodiment of the present invention.

Referring to FIG. 5, the fluid treating apparatus of the current embodiment includes a compact disk (CD) type substrate 110, a spindle motor 105 which rotates the substrate 110, and a laser light source 150 irradiating laser light (L) toward the substrate 1 10. The substrate 110 includes upper and lower plates 111 and 114 bonded together. Channels 120 are formed in the lower plate 114 in a radially arranged fashion. First fluid chambers 115 are formed in a center portion of the substrate 110 and connected to a first end of the channels 120, respectively. Second fluid chambers 116 are formed along the circumference of the substrate 110 and are connected to a second end of the channels 120, respectively.

A plurality of valve substance containers 130 are formed along each of the channels 120. A plurality of valve connection paths 132 are formed along each of the channels 120 to connect the valve substance containers 130 and the channel 120. A plurality of pairs of drain chambers 134 and 135 are formed along each of the channels 120 at both sides of the valve connection paths 132. The valve substance container 130, the valve connection path 132, a pair of the drain chambers 134 and 135, the laser light source 150 are included in a valve unit (refer to FIG. 2A). Reference numeral 113 denotes fluid injection holes formed in the upper plate 111 to introduce a fluid (e.g., blood samples or reaction solutions) into the first fluid chambers 115.

Referring to FIG. 6A, laser light is irradiated to a first valve substance container 130(*i*) that is nearest to the second fluid chamber 116 so as to close the channel 120 using a valve substance (V). Then, laser light is irradiated to a portion of the channel 120 between a pair of drain chambers 134(*i*) and 135(*i*) so as to open the channel 120 again. A photographic image of this state, a photograph is shown in FIG. 6A. After introducing a fluid into the first fluid chamber 115, the substrate 110 (refer to FIG. 5) is rotated several times. Then, the fluid is moved from the first fluid chamber 115 to the second fluid chamber 116 through the channel 120. This shows that the channel 120 is opened.

Referring to FIG. 6B, laser light is irradiated to a second valve substance container 130(ii) that is second nearest to the second fluid chamber 116 so as to close the channel 120 using a valve substance (V). A photographic image of this state is shown in FIG. 6B. After introducing a fluid again into the first fluid chamber 115, the substrate 110 is rotated several times. However, the fluid is not moved from the first fluid chamber 115 to the second fluid chamber 116 through the channel 120. This shows that the channel 120 is closed.

Referring to FIG. 6C, laser light is irradiated to a portion of the channel 120 between a pair of drain chambers 134(*ii*) and 135(*ii*) that are near to the second valve substance container 130(*ii*) so as to open the channel 120 again. A photographic image of this state is shown in FIG. 6C. Then, the substrate 110 is rotated several times. As a result, the fluid in the first fluid chamber 115 is moved to the second fluid chamber 116 through the channel 120, and thus the fluid level of the second fluid chamber 116 is increased. This shows that the channel 120 is opened again.

FIGS. 7A through 7E are plan views for explaining an operation of a valve unit 60 according to another embodiment of the present invention.

Referring to FIGS. 7A through 7E, the valve unit 60 of the current embodiment includes a valve substance container 62, a valve substance (V) contained in the valve substance container 62, a pair of valve connection paths 63 and 64 connecting a pair of channels 36 and 37 to the valve substance container 62, and two pairs of drain chambers 66, 67, 68, and 69. The drain chambers 66 and 67 are spaced each other and formed along the channel 36. The valve connection path 63 is fluid connected to the channel 36 between the drain chamber 66 and the drain chamber 67. Likewise, The drain chambers 68 and 69 are spaced each other and formed along the channel 37. The valve connection path 64 is fluid connected to the channel 37 between the drain chamber 68 and the drain chamber 69. The valve unit 60 further includes an external laser light source (refer to FIG. 2A) so as to supply energy to the valve substance (V). The valve substance (V) and the laser light source are described in detail with reference to FIGS. 2A through 2F. Thus, descriptions thereof will be omitted.

Figure 7A:
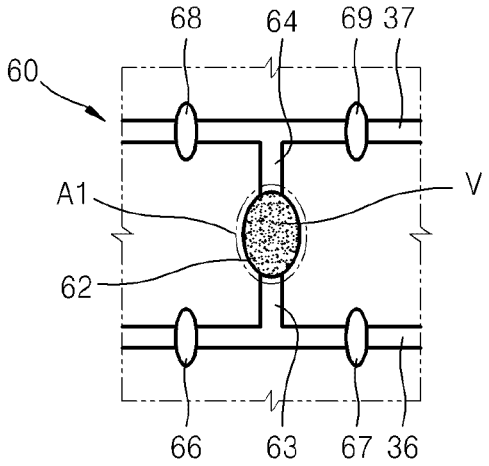
FIGS. 7A through 7E are plan views for explaining an operation of a valve unit according to another embodiment of the present invention.

Referring to FIG. 7A, laser light is irradiated for a short time to the valve substance (V), which is in non-fluidic phase (i.e., solid or hardened) inside the valve substance container 62. Reference character Al denotes an area irradiated by the laser light. Then, referring to FIG. 7B, the valve substance (V) rapidly expands while changing in its fluidic phase (i.e., melting) and thus flows into the channels 36 and 37 through the pair of valve connection paths 63 and 64. The valve substance (V) introduced into the channels 36 and 37 further flows by the capillary phenomenon and hardens in the channels 36 and 37, thereby closing the channels 36 and 37. As a result, part of the valve substance (V), which is in its fluidic phase, may be introduced into the drain chambers 66, 67, 68, and 69.

Figure 7B:
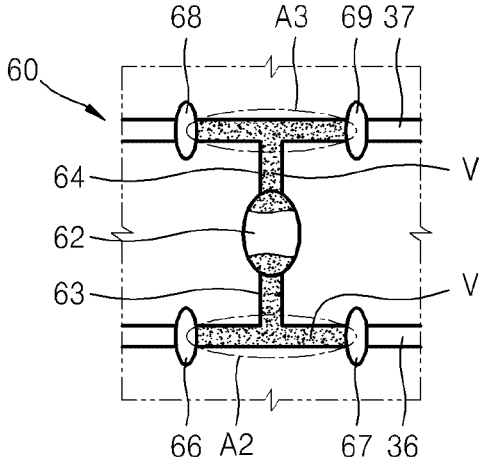
Figure 7C:
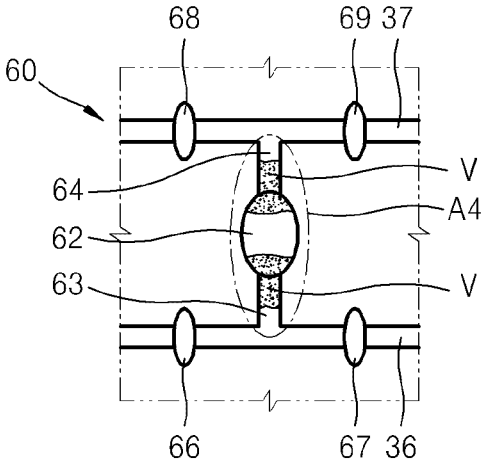

Laser light is irradiated again for a short time to the non-fluidic (hardened) valve substance (V) in the channels 36 and 37 between the drain chambers 66, 67, 68, and 69. In FIG. 7B, reference characters A2 and A3 each denote irradiation areas of the laser light. As described above, then, the valve substance (V) expands instantly while melting and is removed from the channels 36 and 37. Thus, as shown in FIG. 7C, the channels 36 and 37 are opened again, and fluid (F) can flow along the channels 36 and 37.

Figure 7D:
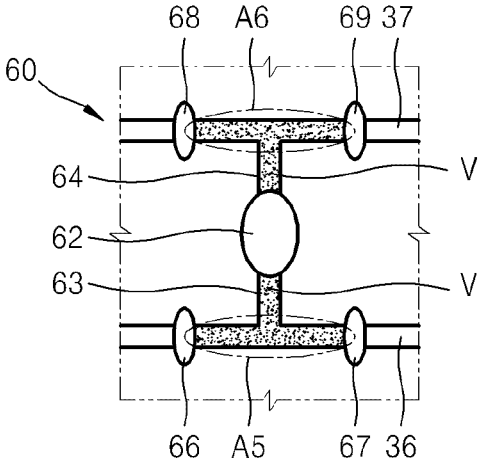

Thereafter, laser light is irradiated again for a short time to the remainder of the non-fluidic (hardened) valve substance (V) in the valve substance container 62 and the valve connection paths 63 and 64. Reference character A4 denotes an area irradiated by the laser light. Then, as shown in FIG. 7D, the valve substance instantly expands while melting and flows into the channels 36 and 37. The valve substance (V) stays the channels 36 and 37 and hardens, and thus the channels 36 and 37 are closed again.

Figure 7E:
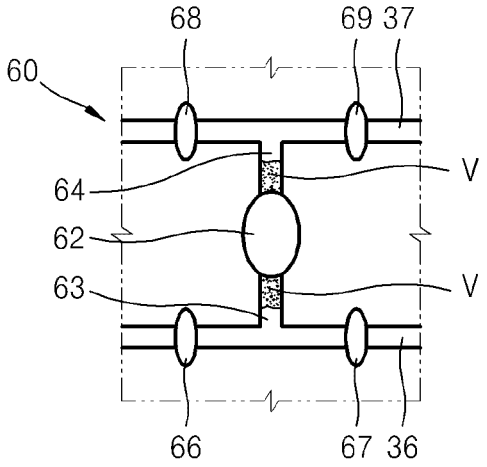

Laser light is irradiated again for a short time to the non-fluidic (hardened) valve substance (V) in the channels 36 and 37 between the drain chambers 66, 67, 68, and 69. In FIG. 7D, reference characters A5 and A6 denote areas irradiated by the laser light. Then, the valve substance (V) instantly expands while melting and is removed from the channels 36 and 37. Thus, as shown in FIG. 7E, the channels 36 and 37 are opened again. In this way, the channels 36 and 37 can be repeatedly closed and opened by adjusting the initial amount of the valve substance contained in the container 62 and the amount of the valve substance which is melted and used to block the channel, which can be done by adjusting the condition of the laser light irradiation and the temperature-melting point properties of the valve substance and the distance of the valve connection paths 64 and 63.

Figure 8A:
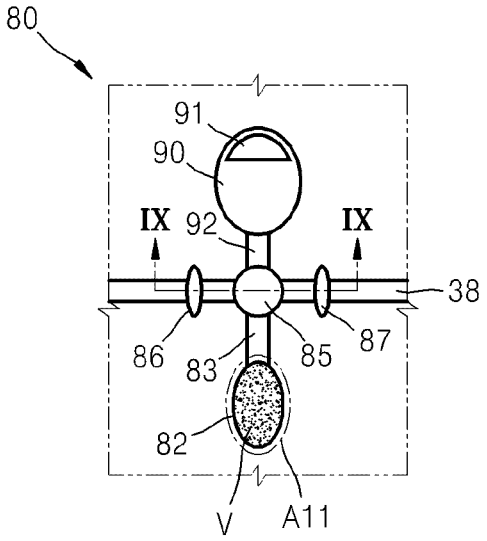
FIGS. 8A through 8E are plan views for explaining an operation of a valve unit according to another embodiment of the present invention.
Figure 8B:
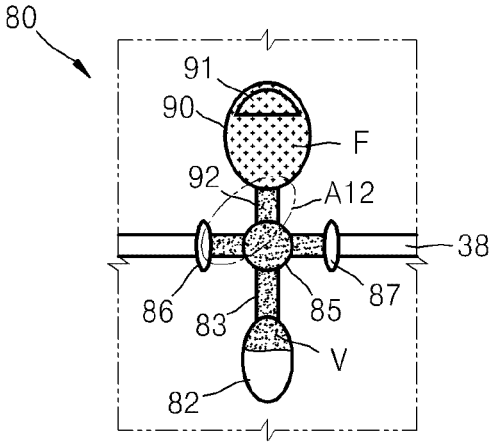
Figure 8C:
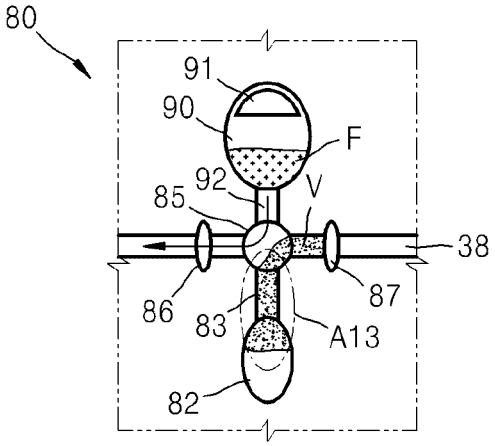
Figure 8D:
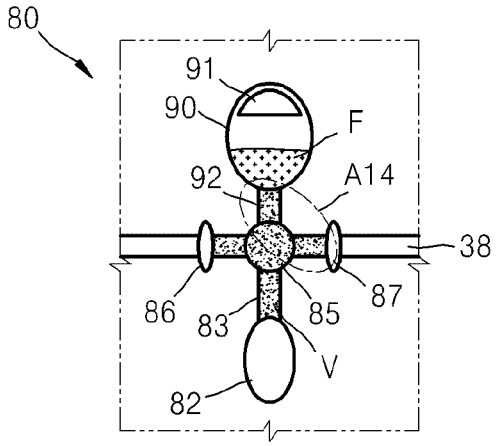
Figure 8E:
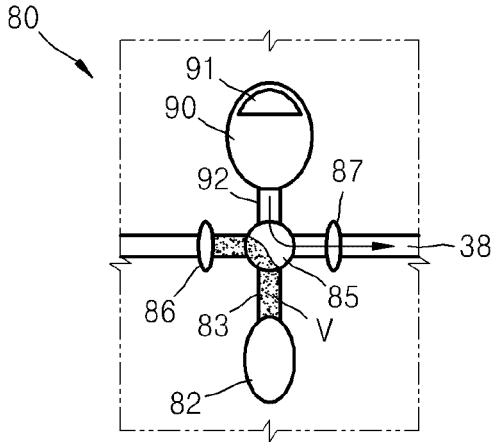
Figure 9:
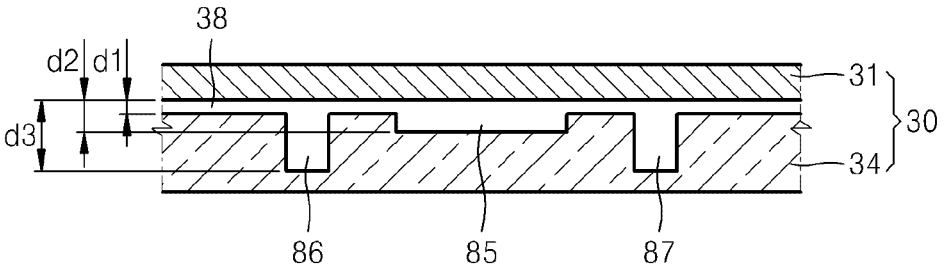
FIG. 9 is a sectional view taken along line IX-IX of FIG. 8A for explaining an operation of the valve unit according to an embodiment of the present invention.

FIGS. 8A through 8E are plan views for explaining an operation of a valve unit 80 according to another embodiment of the present invention, and FIG. 9 is a sectional view taken along line IX-IX of FIG. 8A for explaining the operation of the valve unit, according to an embodiment of the present invention.

Referring to FIGS. 8A through 8E and 9, the valve unit 80 according to the current embodiment of the present invention includes a valve substance container 82, a valve substance (V) filled in the valve substance container 82, a valve connection path 83 connecting a channel 38 and the valve substance container 82, a pair of drain chambers 86 and 87, each spaced from the other and formed along the channel 83, and a laser light source (refer to FIG. 2A) supplying energy to the valve substance (V). An intersection groove 85 is formed at an intersection point where the valve connection path 83 and the channel 38 meet. The depth ("d2") of the intersection groove 85 is not greater than the depth ("d3") of the drain chambers 86 and 87 but larger than that ("d1") of the channel 38.

In the current embodiment, the valve unit 80 further includes a fluid chamber 90 for containing fluid and a fluid connection path 92 connecting the fluid chamber 90 and the intersection groove 85. The valve substance container 82, the channel 38, the valve connection path 83, the drain chambers 86 and 87, the fluid connection path 92, and the intersection groove 85 are formed in a lower plate 34 of a substrate 30. Reference numeral 91 denotes a fluid injection hole formed in an upper plate 31 for introducing fluid into the fluid chamber 90. Meanwhile, since the valve substance (V) and the laser light source are described in detail with reference to FIGS. 2A through 2F, descriptions thereof will be omitted.

Referring to FIG. 8A, laser light is irradiated for a short time to the valve substance (V), which is in its non-fluidic phase (i.e., hardened) inside the valve substance container 82. Reference character A11 denotes an area irradiated by the laser light. Then, as shown in FIG. 8B, the valve substance (V) instantly expands while melting and thus flows into the intersection groove 85, the channel 38, and the fluid connection path 92 through the valve connection path 83. The valve substance (V) introduced into the intersection groove 85 and the channel 38 further flows by the capillary phenomenon and hardens in the intersection groove 85 and the channel 38. Therefore, the channel 38 is closed. Some of the valve substance (V) can be filled into the drain chambers 86 and 87. Part of the valve substance (V) may be introduced into the fluid connection path 92 and hardens therein. Here, when fluid (F) is injected into the fluid chamber 90, the fluid (F) cannot flow to the channel 38 since the fluid connection path 92 is closed.

Laser light is irradiated for a short time to a portion of the intersection groove 85, the fluid connection path 92, and a portion of the channel 38 between the intersection groove 85 and the left drain chamber 86. In FIG. 8B, reference characters A12 denotes an area irradiated by the laser light. Then, the valve substance (V) hardened in the area A12 melts again and expands explosively. Therefore, as shown in FIG. 8C, the left side of the channel 38 to the fluid connection path 92 and the intersection groove 85 can be opened to allow the fluid (F) to flow from the fluid chamber 90 to the left side of the channel 38 as indicated by the arrow.

Thereafter, laser light is irradiated again for a short time to the hardened valve substance (V) in the valve substance container 82 and the valve connection paths 83. Reference character A13 denotes an area irradiated by the laser light. Then, as shown in FIG. 8D, the valve substance (V) instantly expands while melting and flows into the intersection groove 85, a portion of the channel 38 between the intersection and the left drain chamber 86, and the fluid connection path 92. In this state, the valve substance (V) hardens, and thus the fluid (F) in the fluid chamber 90 cannot flow into the channel 38.

In this time, laser light is irradiated for a short time to the hardened valve substance (V) in a portion of the channel 38 between the intersection groove 85 and the right drain chamber 87, the fluid connection path 92, and a portion of the intersection groove 85. In FIG. 8D, reference characters A14 denotes an area irradiated by the laser light. Then, the valve substance (V) in the area A14 melts again and expands instantly. Therefore, as shown in FIG. 8E, the right side of the channel 38 to the fluid connection path 92 and the intersection groove 85 can be opened to allow the fluid (F) to flow from the fluid chamber 90 to the right side of the channel 38 as indicated by the arrow. According to the current embodiment of the present invention, the flow of fluid can be controlled in a desired direction using the valve unit 80.

Meanwhile, according to another embodiment of the present invention, a valve unit can close and open a channel by supplying energy to a valve substance formed of a phase change material without fine thermal particles. Further, a microfluidic device employing the valve unit can be provided.

According to the present invention, a channel can be opened and closed using only a single valve unit. Therefore, a compact and highly integrated fluid reaction substrate can be provided. Furthermore, the costs and time required for manufacturing a fluid reaction substrate can be reduced.

In addition, a channel can be opened and closed a plurality of times using the valve unit. As a result, a fluid reaction substrate can have a simple fluid passage, and thus it is easy to design a fluid reaction substrate. In addition, a fluid reaction substrate is reusable.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A valve unit comprising:

a channel which forms a fluid passage;

a first and a second drain chambers formed along the channel, the drain chambers being spaced from each other;

a valve substance including a phase change material that is non-fluidic at ambient temperature and fluidic when energy is applied thereto;

a valve substance container which contains the valve substance; and a valve connection path which connects the valve substance container to the channel, in which a connection point of the channel where the valve connection path meets the channel is located between the first drain chamber and the second drain chamber, wherein when energy is applied to the valve substance contained in the valve substance container, the valve substance becomes fluidic and at least portion of the valve substance flows to the channel through the valve connection path, and the portion of the valve substance flowed in the channel becomes non-fluidic and blocks the channel in both an area between the first drain chamber and the connection point and an area between the second drain chamber and the connection point; and when energy is applied to the portion of the valve substance blocking the channel, the portion of the valve substance becomes fluidic and the channel is adapted to discharge the fluidic portion of the valve substance to at least one of the drain chambers to open the channel, wherein the valve substance container is connected to a plurality of separate channels each through a respective valve connection path, each of the plurality of separate channels forming a fluid passage and provided with drain chambers on both sides of the respective valve connection path; and wherein said separate channels extend opposite from each other and run parallel each other.

2. The valve unit of claim 1, wherein the energy is pulsed electromagnetic waves having an energy rate of at least 1 mJ/pulse or continuous electromagnetic waves having a power of at least 10 mW.

3. The valve unit of claim 1, wherein the energy is a laser light having a wavelength in a range of 750 nm to 1300 nm, infrared light or a gas with a temperature at which the phase change material can be melted to a fluidic state.

4. The valve unit of claim 1, wherein the valve substance further comprises thermal particles, which emit heat when energy is applied thereto are dispersed in the phase change material.

5. The valve unit of claim 4, wherein the thermal particles have a diameter in a range of 1 nm to 100 μm and comprise a ferromagnetic material or a metal oxide selected from the group consisting of $Al_2O_3$, $TiO_2$, $Ta_2O_3$, $Fe_2O_3$, $Fe_3O_4$ and $HfO_2$.

6. The valve unit of claim 4, wherein the thermal particles are polymer particles, quantum dots, or magnetic beads.

7. The valve unit of claim 6, wherein the magnetic beads comprise at least one component selected from the group consisting of Fe, Ni, Cr, and an oxide thereof.

8. The valve unit of claim 1, wherein the phase change material is one or more of wax selected from the group consisting of paraffin wax, microcrystalline wax, synthetic wax, natural wax and mixtures thereof; a gel selected from the group consisting of polyacrylamide, polyacrylate, polymethacrylate, polyvinylamide and mixtures thereof; and a thermoplastic resin selected from the group consisting of cyclic olefin copolymer(COC), polymethylmethacrylate (PMMA), polycarbonate(PC), polystyrene(PS), polyoxymethylene(POM), perfluoralkoxy(PFA), polyvinylchloride (PVC), polypropylene(PP), polyethylene terephthalate (PET), polyetheretherketone(PEEK), polyamide(PA), polysulfone(PSU), polyvinylidene fluoride(PVDF) and mixtures thereof.

9. The valve unit of claim 1, wherein the valve substance container is connected to a plurality of separate channels each through a valve connection path, each of the channels forming the fluid passage and provided with the first drain chamber and the second drain chamber.

10. The valve unit of claim 1, further comprising:

a fluid chamber which contains a fluid; and a fluid connection path which connects the fluid chamber to the channel at a point of the channel between the first drain chamber and the second drain chamber, wherein the fluid chamber, the fluid connection path, and the valve substance container are in fluid communication with each other, wherein when energy is applied to the valve substance contained in the valve substance container, the valve substance becomes fluidic and at least portion of the valve substance flows into the channel and to the fluid connection path through the valve connection path, and the portion of the valve substance flowed in the channel and the fluid connection path becomes non-fluidic and fills the section of the channel between the first drain chamber and the second drain chamber of the pair of drain chamber and fills the fluid connection path; and when energy is applied to the portion of the valve substance filling the section between the first drain chamber and the second drain chamber of the pair of drain chambers and the fluid connection path, the portion of the valve substance becomes fluidic and discharged to the at least one of the first and the second drain chambers to open the channel and the fluid connection path.

11. The valve unit of claim 1, wherein a depth of the connection point is greater than a depth of the channel.

12. A microfluidic device comprising a substrate which comprises a channel forming a fluid passage and a valve unit closing and opening the channel, the valve unit comprising:

a first and a second drain chambers formed along the channel, the drain chambers being spaced from each other;

a valve substance including a phase change material that is non-fluidic at ambient temperature and fluidic when energy is applied thereto;

a valve substance container which contains the valve substance; and a valve connection path which connects the valve substance container to the channel, in which a connection point of the channel where the valve connection path meets the channel is located between the first drain chamber and the second drain chamber, wherein when energy is applied to the valve substance contained in the valve substance container, the valve substance becomes fluidic and at least portion of the valve substance flows to the channel through the valve connection path, and the portion of the valve substance flowed in the channel becomes non-fluidic and blocks the channel in both an area between the first drain chamber and the connection point and an area between the second drain chamber and the connection point; and when energy is applied to the portion of the valve substance blocking the channel, the portion of the valve substance becomes fluidic and the valve unit is adapted to discharge the fluidic portion of the valve substance to at least one of the drain chambers to open the channel, wherein the valve substance container is connected to a plurality of separate channels each through a respective valve connection path, each of the plurality of separate channels forming a fluid passage and provided with drain chambers on both sides of the respective valve connection path, and wherein said separate channels extend opposite from each other and run parallel each other.

13. The microfluidic device of claim 12, wherein the energy is pulsed electromagnetic waves having an energy rate of at least 1 mJ/pulse or continuous electromagnetic waves having a power of at least 10 mW; or a laser light having a wavelength in a range of 750 nm to 1300 nm, infrared light or gas.

14. The microfluidic device of claim 13, wherein at least a portion of the substrate is transparent.

15. The microfluidic device of claim 12, wherein the valve substance further comprises thermal particles, which emit heat when energy is applied thereto and are dispersed in the phase change material.

16. The microfluidic device of claim 15, wherein the thermal particles have a diameter in a range of 1 nm to 100 μm and comprise a ferromagnetic material or a metal oxide selected from the group consisting of $Al_2O_3$, $TiO_2$, $Ta_2O_3$, $Fe_2O_3$, $Fe_3O_4$ and $HfO_2$.

17. The microfluidic device of claim 15, wherein the fine thermal particles are polymer particles, quantum dots, or magnetic beads.

18. The microfluidic device of claim 17, wherein the magnetic beads comprise at least one component selected from the group consisting of Fe, Ni, Cr, and an oxide thereof.

19. The microfluidic device of claim 12, wherein the phase change material is at least one material selected from the group consisting of wax selected from the group consisting of paraffin wax, microcrystalline wax, synthetic wax, natural wax, and mixtures thereof; a gel selected from the group consisting of polyacrylamide, polyacrylate, polymethacrylate, polyvinylamide, and mixtures thereof; and a thermoplastic resin selected from the group consisting of cyclic olefin copolymer(COC), polymethylmethacrylate(PMMA), polycarbonate(PC), polystyrene(PS), polyoxymethylene(POM), perfluoralkoxy(PFA), polyvinylchloride(PVC), polypropylene(PP), polyethylene terephthalate(PET), polyetheretherketone(PEEK), polyamide(PA), polysulfone(PSU), polyvinylidene fluoride(PVDF) and mixtures thereof.

20. The microfluidic device of claim 12, wherein the substrate comprises a plurality of channels, and the valve substance container is connected to the plurality of channels each through a separate valve connection path, each of the channels forming the fluid passage and provided with the first drain chamber and the second drain chamber.

21. The microfluidic device of claim 12, further comprising:

a fluid chamber which contains a fluid; and a fluid connection path which connects the fluid chamber to the valve substance container at the connection point of the channel, wherein when energy is applied to the valve substance contained in the valve substance container, the valve substance becomes fluidic and at least portion of the valve substance flows to the channel and to the fluid connection path through the valve connection path, and the portion of the valve substance flowed in the channel and the fluid connection path becomes non-fluidic and blocks the channel and the fluid connection path; and when energy is applied to the portion of the valve substance blocking the channel and the fluid connection path, the portion of the valve substance becomes fluidic and discharged to the drain chambers to open the channel and the fluid connection path.

22. The microfluidic device of claim 12, further comprising an actuating unit rotating the substrate, wherein the fluid is pumped by a centrifugal force generated when the actuating unit rotates the substrate.

23. A microfluidic substrate comprising:

a channel which forms a fluid passage;

a first and a second drain chambers formed along the channel, the drain chambers being spaced from each other;

a valve substance including a phase change material that is non-fluidic at ambient temperature and fluidic when energy is applied thereto;

a valve substance container which contains the valve substance; and a valve connection path which connects the valve substance container to the channel, in which a connection point of the channel where the valve connection path meets the channel is located between the first drain chamber and the second drain chamber, wherein when energy is applied to the valve substance contained in the valve substance container, the valve substance becomes fluidic and at least portion of the valve substance flows to the channel through the valve connection path, and the portion of the valve substance flowed in the channel becomes non-fluidic and blocks the channel in both an area between the first drain chamber and the connection point and an area between the second drain chamber and the connection point; and when energy is applied to the portion of the valve substance blocking the channel, the portion of the valve substance becomes fluidic and the channel is adapted to discharge the fluidic portion of the valve substance to at least one of the drain chambers to open the channel, wherein the valve substance container is connected to a plurality of separate channels each through a respective valve connection path, each of the plurality of separate channels forming a fluid passage and provided with drain chambers on both sides of the respective valve connection path; and wherein said separate channels extend opposite from each other and run parallel each other.

24. The microfluidic substrate of claim 23, wherein the valve substance further comprises thermal particles, which emit heat when energy is applied thereto, dispersed in the phase change material.

25. The microfluidic substrate of claim 23, further comprising:

a fluid chamber which contains a fluid; and a fluid connection path which connects the fluid chamber to the valve substance container at the connection point of the channel, wherein when energy is applied to the valve substance contained in the valve substance container, the valve substance becomes fluidic and at least portion of the valve substance flows to the channel and to the fluid connection path through the valve connection path, and the portion of the valve substance flowed in the channel and the fluid connection path becomes non-fluidic and blocks the channel and the fluid connection path; and when energy is applied to the portion of the valve substance blocking the channel and the fluid connection path, the portion of the valve substance becomes fluidic and discharged to the drain chambers to open the channel and the fluid connection path.

26. The microfluidic substrate of claim 23, which is at least partially transparent.

* * * * *